US005351440A

United States Patent [19]

Vincent

[11] Patent Number: 5,351,440

[45] Date of Patent: Oct. 4, 1994

[54] VERTICAL LIFT DEVICE

[76] Inventor: Lloyd Vincent, P.O. Box 1019, Three Rivers, Calif. 93271

[21] Appl. No.: 982,431

[22] Filed: Nov. 27, 1992

[51] Int. Cl.[5] ..... E05F 11/24

[52] U.S. Cl. ..... 49/340; 49/338; 49/385; 49/27

[58] Field of Search ..... 49/340, 345, 385, 27, 49/334, 338; 5/136

[56] References Cited

U.S. PATENT DOCUMENTS

| | | | |
|---|---|---|---|
| 1,269,545 | 6/1918 | Mengedoht | 49/340 |
| 2,551,239 | 5/1951 | Bond | 49/340 |
| 3,303,303 | 2/1967 | Miller | 49/27 |
| 3,333,362 | 8/1967 | Kostin et al. | 49/340 |
| 4,051,746 | 10/1977 | Liljeros | 49/340 |
| 4,337,670 | 7/1982 | Carlson | 49/340 |
| 4,429,264 | 1/1984 | Richmond | 49/340 |
| 4,735,018 | 4/1988 | Duncan et al. | 49/340 |
| 4,986,031 | 1/1991 | Agnew et al. | 49/340 |
| 5,079,417 | 1/1992 | Strand | 49/27 |
| 5,142,822 | 9/1992 | Beckerman | 49/27 |

*Primary Examiner*—Michael J. Milano
*Attorney, Agent, or Firm*—Dennis B. Haase

[57] ABSTRACT

Apparatus for controlled raising and lowering of a barrier about a pivot point in which optimum control forces are applied to the barrier throughout its range of operation, and in which sensors are provided to prevent movement of the barrier against a resistive force to thereby prevent damage to the barrier, its operative mechanism, or an external object in its path.

16 Claims, 2 Drawing Sheets

70
17
70
G
G
70
17
F
12
32
10
24
14
72
70

17
32
10
12
60
62
G
19
67
47
41
64
67
27
36
80
70
24
29
45
43
49
38
34
14
28

G
17
22
27
19
41
38
29
36
24
22
45
47
43
49
34

VERTICAL LIFT DEVICE

The present invention relates generally to automated barrier lifting mechanisms, and more particularly to apparatus for rotating a barrier, such as a gate or the like, in a vertical plane to raise and lower the same.

BACKGROUND OF THE INVENTION

1. Field of the Invention

The automation of gates began primarily as a safety and security matter, and railroad crossing gates were probably among the first to be automated.

The concept quickly emerged as a convenience, but because of the costs involved, was enjoyed primarily by the more affluent. With the advent of inexpensive electronics and infra red controls, automated gates have become available to virtually anyone who wanted them.

Gates, whether for safety, or security, or convenience are typically not space efficient. Whether single or split, every gate is at least as long as the distance between the gate posts. Whether the gate, or components thereof, swing out, or in, or are drawn back along a fence, an inordinate amount of space is required to swing between the open and closed positions, and when a gate is at rest in the open position, storage space is required, which is then simply not usable for any other purpose.

In most settings, there is space available for storage of an opened gate which is very seldom used, and that is the airspace above the gateway. While such space is readily available and clearly alleviates space problems, concerns regarding weight of the unit and safety for those passing under or through the plane of the gate have inhibited use of this valuable space. The present invention addresses these concerns and resolves them in a novel manner.

2. Overview of the Prior Art

Within the scope of the inquiry of automated gates, there are a multitude of combinations and permutations of electric and electro-mechanical devices which are representative of the prior art. Vollmer U.S. Pat. No. 3,500,585 is but one example of a hydraulic unit. Such gates may swing inwardly or outwardly, and many are withdrawn to the left or right, in the plane of the gate, typically by pulling with a chain so that the gate retracts on a track.

When the inquiry becomes more specific to gates which are moved in a vertical plane to achieve an open position, the quantum of prior art quickly recedes.

Already mentioned are railroad crossing gates, although such devices are .not truly gates, but rather light weight warning devices, which are readily, and frequently, violated.

A lift mechanism for railroad crossing gates is shown in Reinitz et. al U.S. Pat. No. 3,394,498. The Reinitz approach, however, provides for very limited movement and is incapable of handling any significant weight and, indeed, was never meant to handle weight. Unlike the present invention, Reinitz et. al, and those who follow the same design, inevitably require that the gate lifted be counterbalanced, and that is simply not necessary within the framework of the present invention.

To the extent that any vertical gate lift mechanism can be considered typical, it would be those gates mounted in vertical tracks and raised and lowered by chain, and such mechanism is far afield from that of the present invention.

SUMMARY OF THE PRESENT INVENTION

The present invention accomplishes the optimum use of space by providing a mechanism for raising and lowering a barrier, such as a gate, in a vertical plane, uniquely about a single pivot point, with the same safety and ease attributable to the universal standard "swinging gate", which moves about a vertical axis, and which, by virtue of its axis of movement, but without the requirement for an inordinate amount of space relative to its utility.

It is another feature of the present invention that it employs a hydraulic motor positively attached to the barrier, or gate, to be raised and lowered in such a manner as to permit application of optimum force on the barrier irrespective of its position, thereby permitting the use of relatively smaller motors than otherwise might be required for a barrier of given weight. Chains, belts and other intermediate devices which often break for tangle are eliminated.

It is an objective of the present invention, in addition to the aforementioned, to provide means for constant positive control over the barrier, irrespective of its position, so that the need for counterweight is totally obviated.

As a corollary to the foregoing, by virtue its ability to maintain optimum force on the barrier at all times, the mechanism provides maximum safety despite the existence of great stored energy in the form of a gate of significant weight having been elevated for a period of time. Safety is further enhanced by the provision of resistance sensing devices which automatically cut power to the gate, and hold it in position when resistance to movement is encountered.

All of the foregoing advantages are achieved by a power assembly which is compact, easily maintained and relatively less expensive than prior units normally required to handle the loads experienced.

DESCRIPTION OF THE DRAWINGS

Having described the environment in which the present invention has particular, although not exclusive utility, and elaborated on certain of the invention's special features, a more detailed description will be provided in conjunction with the accompanying drawings, wherein.

DESCRIPTION OF A PREFERRED EMBODIMENT

Figure 1:
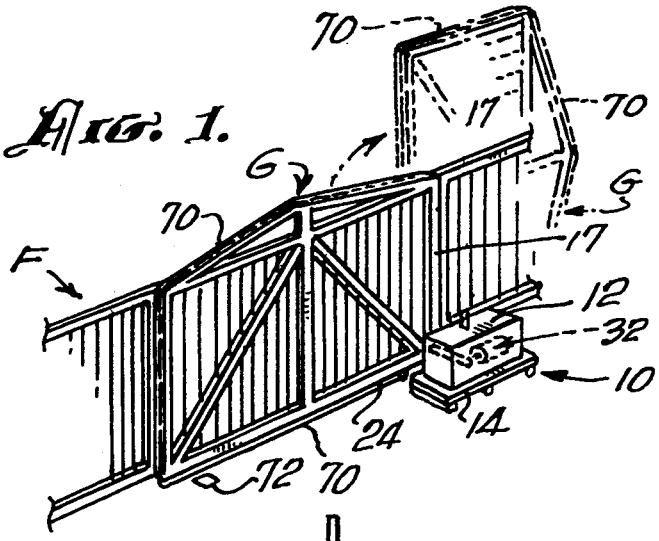
FIG. 1 is a pictorial representation of a gate, or barrier, controlled by the mechanism constructed in accordance with the present invention.

In order to establish the setting within which the present invention has its greatest utility, reference will first be made to FIG. 1, which depicts a portion of an enclosure surrounded by a fence F, an entrance to which is protected by a barrier, in the form of a gate, G.

A barrier lifting device is shown at 10, and in its commercial form, is encased in a removable shroud 12, while secured to a platform 14, which is intended to protect the system from moisture normally experienced at ground level. By way of example, the platform 14 may comprise a concrete foundation wherein the lifting device is secured thereto by anchor bolts so that the entire unit is elevated somewhat from ground level.

Figure 2:
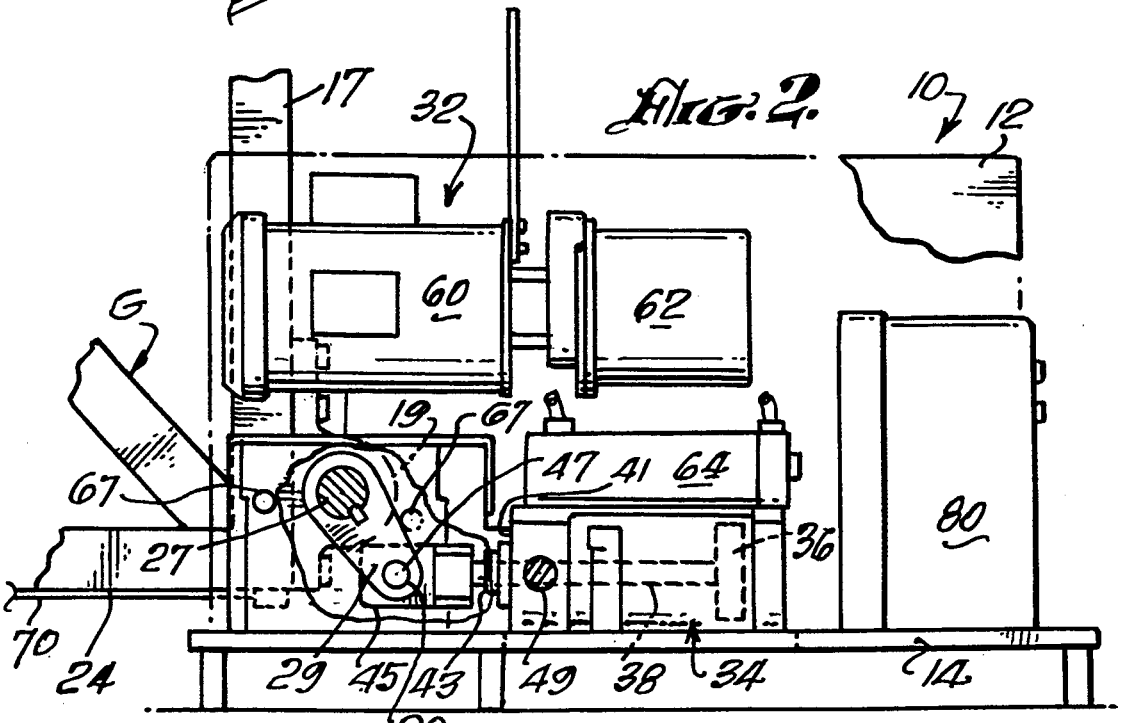
FIG. 2 is a side elevation of the mechanism of the present invention, shown with the cover removed, and partially sectioned to illustrate specific features.
Figure 3:
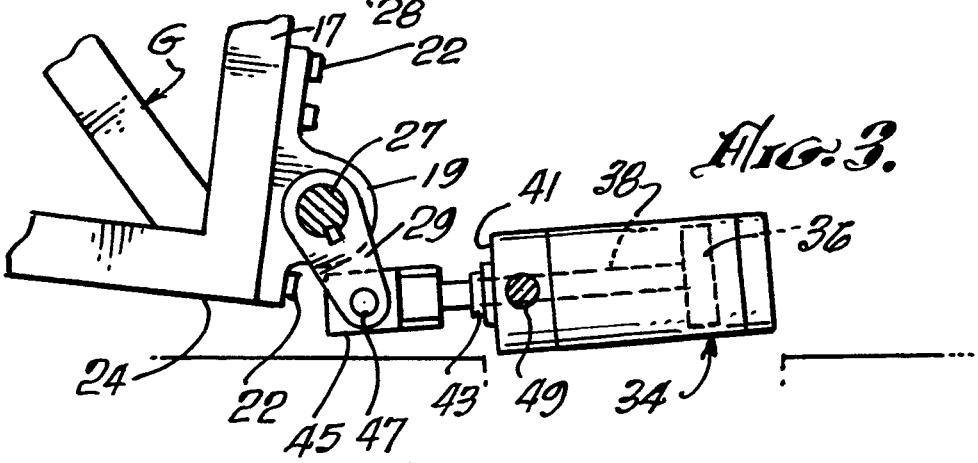
FIGS. 3, 4, and 5 illustrate the relative positions of the various parts of the motor and the barrier as it is raised to the full open position of FIG. 5.

Referring next to FIGS. 2 and 3, it is a function of the lift mechanism to rotate the gate member G about a pivot point, in a vertical plane. To this end, a vertical support member 17, of the gate G is fitted with a shaft receiving device, or bracket, 19, secured by means of fasteners 22, at its lowermost end 24. A horizontally disposed shaft 27 is pinned, or keyed, in any well known manner, within the shaft receiving device 19 so as to preclude rotation of the shaft 27 relative to the gate G. As may be seen in the drawings, the shaft 27 is anchored and serves as the barrier pivot point.

The end of the shaft 27 has parallel links 29 rigidly affixed thereto, again in any well known manner, and each of said links has a remote free end 28 extending downwardly from the shaft 27, as seen in FIG. 2 with the gate G in the closed position.

While the specific form of motive force to operate the system may vary with availability of power sources, it has been found that the use of hydraulics is particularly suited to the accomplishment of the objectives of the present invention by virtue of its dampening characteristics, and its ability to generate relatively greater forces with relatively less power use in a small compact assembly.

Accordingly, a hydraulic motor 32 is provided which, as best seen in FIG. 3, comprises a cylinder 34, in which a piston 36 reciprocates, under hydraulic pressure delivered to one side of the other of the piston. A piston rod 38 is either formed integrally with, or otherwise attached to the piston 36 transverse thereto, and extends through the end wall 41 of the cylinder 34. A suitable seal 43 encircles the rod 38 at the wall 41 to prevent fluid leakage. The free end 45 of the rod 38, as best seen in FIG. 3, attaches to the links 29 by means of wrist pin 47. In order to provide strength and prevent rotation of the rod, the free end 45 is machined on either side to provide flat surfaces to be fitted between the two links and is relatively rotatable about the pin 47 by means of a bearing not shown.

In order to apply optimum force to the link 29 at all times and irrespective of the position of the link, it is important that application of force to the pin 47 is always along the longitudinal axis of the rod 38. To ensure accomplishment of this feature of the invention, the cylinder is mounted in bearing mounts 49 secured in upstanding frame members 52, which are themselves secured to the platform 14.

Figure 4:
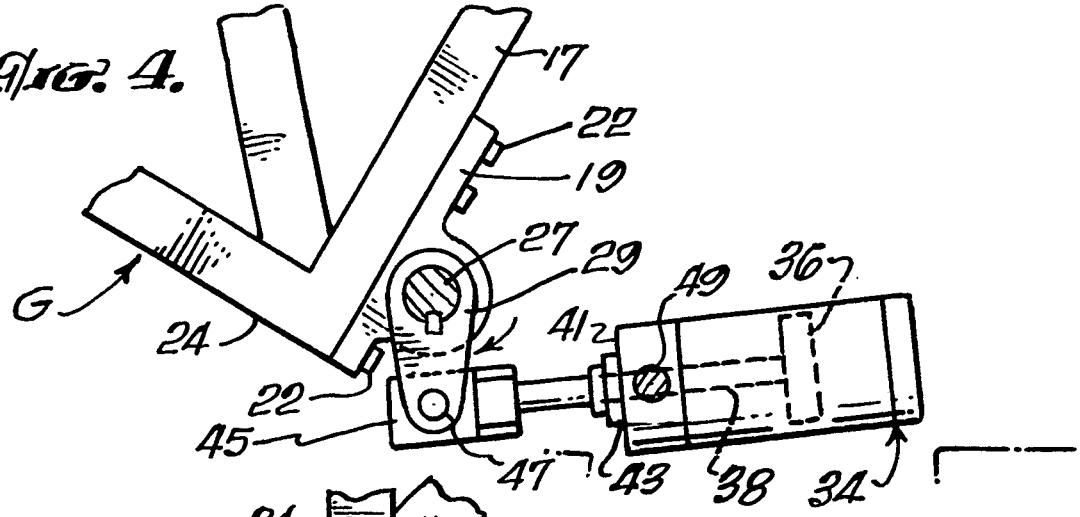
Figure 5:
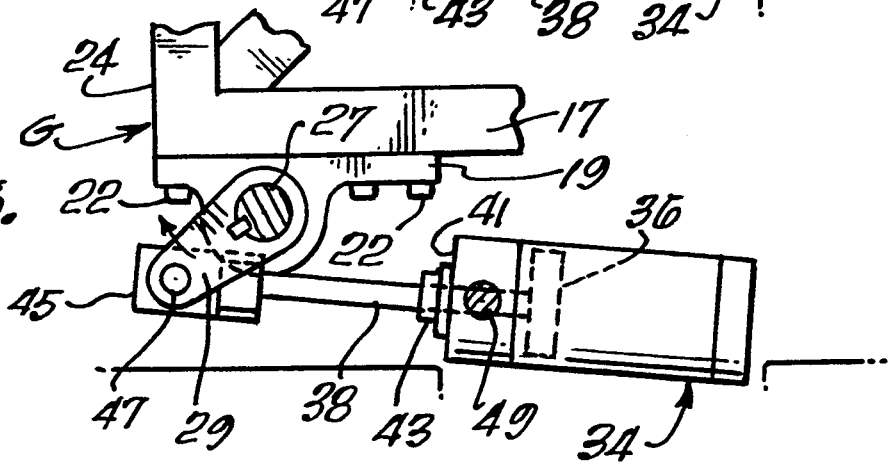
Figure 6:
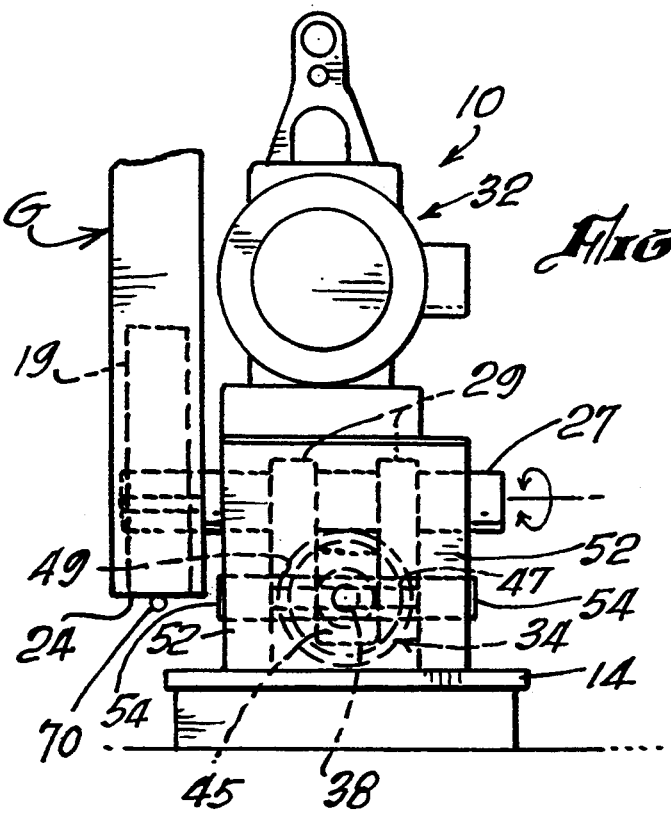
FIG. 6 is an end view of the mechanism of the present invention illustrating the positions of the gate and lift mechanism from that point of view.

Trunions 54 are mounted to, and project outwardly from, the cylinder end wall 41, coaxially in a plane transverse to that of the cylinder. To ensure application of straight line forces at all times with torquing or side loading the rod 38, the trunions 54 are positioned in close proximity to the forward end 41 of the cylinder 34, and may even be placed at the end in some cases. The bearing mounts 49 and trunions 54 secure the cylinder in the framework of the unit in a manner which permits free movement of the power application end of the cylinder about the trunions 54, with the result that the longitudinal axis of the rod 38 will pass through the center of the pin 47 at all times during extension and retraction thereof. Accordingly, full hydraulic pressure applied to the face of the piston 36 is transmitted through the free end 45 of the rod 38, to the pin 47 and is, thus, available to move the link 29, and, thus, the gate G through its full range of motion as seen in FIGS. 3, 4, and 5, with complete positive control.

A further attribute of the foregoing mounting arrangement devised for the cylinder is the complete avoidance of any binding of the rod in the cylinder. Since the cylinder and rod are always coaxial, no torquing or twisting of the rod 38 will occur regardless of the load on the free end 45 or the direction of that load.

Actuation of the hydraulic motor is relatively straight forward. An electric motor 60 is illustrated, primarily because of the ready availability of electric power, to drive a pump 62. Obviously, other power sources may be used. The pump 62 creates fluid pressure in a plenum, or shown, alternately apply and relieve pressure to one side or the other of the piston 36 in a well known manner, to reciprocate the rod 38. As shown, the plenum 64 is mounted to, and moves with, the cylinder 34, thereby greatly simplifying the plumbing required. The plenum is so configured as to store fluid under pressure so that if there is a power failure or failure of a hydraulic line it will not cause failure of the system, nor loss of control. More particularly, the fluid under pressure in the plenum will excite the valving system to lock the fluid motor and, thus, the barrier, in the position it is in at the time of failure, where it will remain until moved by manual manipulation of the controls.

It is clearly desirable to provide limits to the movement of the gate, and to have the capacity to stop its movement instantaneously, and with a minimum of "bounce". Limits to the gate's range of movement are established by means of limit switches 67.

Such switches are typically adjustable, and, as shown, placed in the path of the links 29 to signal the arrival of the gate at upper and lower limits, and to stop it there. The limit switches may be configured to simply break the circuit at a control unit, or panel P, and the pump is stopped. As a result, the pressure in the plenum, and thus the cylinder, remains constant, and the gate movement is halted at the position it is in at the time of the circuit break.

Since the gate G may weigh several hundred pounds, it represents a considerable amount of stored energy when being elevated or lowered. In order to control the obvious hazard this presents, the invention contemplates the use of sensing devices which respond to slight pressures to prevent inadvertent dropping of the gate.

Thus, there is provided a series of sensor wires 70, which carry a small current. Each of the wires 70 are disposed along the perimeter of the gate G as seen in FIGS. 1 and 2. A ground pin 72 is attached to the gate and extend toward the wire 70 to a point in close proximity to the wire. As the gate moves, should it meet resistance in any form from a proximate outside source, the wire, which is taut, will be forced by the outside pressure to flex inwardly to contact the ground pin, at which time the control circuit reverses the hydraulic valving, to move the gate away from the obstruction. It is a significant feature of the present invention that it is capable of sensing obstructions while being raised, as well as lowered. Upward motion is also protected in a like manner, with the exception that if an obstruction is sensed, the unit halts all motion and remains locked in that position until the obstruction is cleared and the controls reset.

In this manner, people and vehicles alike are protected from the inadvertent downward movement of the gate.

The controls for the gate are secured against adverse weather and other such conditions in control box 80, and are of a known type which is capable of both manual and automatic modes. Moreover, the automatic system may use infra red, or RF signals without departure from the invention.

Having now described a preferred embodiment of the present invention, what is claimed is:

1. Apparatus for raising and lowering a barrier, in a vertical plane, wherein the barrier is rotatable about a fixed pivot comprising, in combination a hydraulic motor, said motor being anchored relative to the barrier at a predetermined distance therefrom, and operable in coplaner relationship with the barrier;

a link affixed to the barrier at its pivot point and an end thereof extending therebelow; said motor being attached to said end of said link such that when said motor extends or retracts, said barrier is raised and lowered in response thereto;

and said motor having trunions disposed thereon to secure said motor against transverse displacement, fixed bearing members for receipt of said trunions to permit rotation of said motor in said bearing members in a plane parallel to the plane of rotation of the barrier such that optimum force is consistently applied on said barrier irrespective of its pivot;

and control means for operating said motor in response to a signal.

2. The apparatus as set forth in clam 1, wherein said trunions are disposed on said hydraulic motor towards the end thereof closest to said link.

3. The apparatus set as forth in clam 1, wherein said hydraulic motor includes a cylinder; a piston reciprocally mounted in said cylinder, a piston rod, said piston rod having a free end projecting outwardly from an end of said cylinder;

said free end of said rod being rotatably attached to said link at a point below said pivot point.

4. The apparatus as set forth in clam 2, wherein said cylinder includes a piston reciprocally mounted in said cylinder, a piston rod, said piston rod having a free end projecting outwardly from an end of said cylinder;

said free end of said rod being rotatably attached to said link at a point below said pivot point.

5. The apparatus as set forth in clam 1, wherein said hydraulic motor includes a plenum for storage of hydraulic fluid under pressure; control means is provided, operable through said plenum, to stop said hydraulic motor when a system malfunction occurs, to thereby prevent said barrier from moving from its position at the time of system malfunction.

6. The apparatus as set forth in clam 1, wherein the barrier is fixed with sensing means, said sensing means being connected with said control means;

said sensing means being responsive to control pressure to stop the barrier when it makes contact with an object in its path.

7. The apparatus as set forth in clam 7, wherein said sensing means is installed about the perimeter of the barrier.

8. The apparatus as set forth in clam 6, wherein said sensing means is disposed on the sides of the barrier opposite said pivot point, and along the bottom thereof.

9. The apparatus as set forth in claim 2, wherein the barrier is fitted with sensing means, said sensing means being connected with said control means;

said sensing means being responsive to outside pressure to stop the barrier when it makes contact with an object in its path.

10. The apparatus as set forth in claim 2, wherein the barrier is fitted with sensing means, said sensing means being connected with said control means;

said sensing means being responsive to outside pressure to reverse the barrier when it makes contact with an object in its path.

11. The apparatus as set forth in clam 2, wherein said sensing means is installed about the perimeter of the barrier.

12. The apparatus as set forth in clam 1, wherein said trunions being disposed on said hydraulic motor at the end thereof closest to said link.

13. The apparatus as set forth in clam 1, wherein said control means includes limit switches, said limit switches being disposed in the path of said link so as to stop rotation of said gate upon contact therewith so as to define the limits of rotation of the barrier.

14. The apparatus as set forth in clam 2, wherein said control means includes limit switches, said limit switches being disposed in the path of said link so as to stop rotation of said gate upon contact therewith so as to define the limits of rotation of the barrier.

15. The apparatus as set forth in clam 12, wherein said control means includes limit switches, said limit switches being disposed in the path of said link so as to stop rotation of said gate upon contact therewith so as to define the limits of rotation of the barrier.

16. The apparatus as set forth in clam 4, wherein said control means includes limit switches, said limit switches disposed in the path of said link so as to stop rotation of said gate upon contact therewith so as to define the limits of rotation of the barrier.

* * * * *